US007911305B2

(12) United States Patent
Grözinger et al.

(10) Patent No.: US 7,911,305 B2
(45) Date of Patent: Mar. 22, 2011

(54) IGNITION COIL

(75) Inventors: Stefan Grözinger, Blaichach (DE); Reinhard Seidl, Sonthofen (DE); Lothar Detels, Burgberg (DE); Markus Weimert, Immenstadt (DE); Tim Skowronek, Missen-Wilhams (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/580,509

(22) PCT Filed: Nov. 2, 2004

(86) PCT No.: PCT/EP2004/052753

§ 371 (c)(1),
(2), (4) Date: Feb. 21, 2007

(87) PCT Pub. No.: WO2005/059355

PCT Pub. Date: Jun. 30, 2005

(65) Prior Publication Data

US 2007/0256655 A1 Nov. 8, 2007

(30) Foreign Application Priority Data

Dec. 9, 2003 (DE) ..... 103 57 349

(51) Int. Cl.
*H01F 27/02* (2006.01)

(52) U.S. Cl. ..... 336/90; 336/96; 336/198; 123/634

(58) Field of Classification Search ..... 336/90, 336/96, 198; 123/634
See application file for complete search history.

(56) References Cited

U.S. PATENT DOCUMENTS

| | | | | |
|---|---|---|---|---|
| 5,703,462 | A * | 12/1997 | Woody et al. | 320/108 |
| 6,119,667 | A * | 9/2000 | Boyer et al. | 123/634 |
| 6,232,863 | B1 * | 5/2001 | Skinner et al. | 336/96 |
| 6,483,410 | B2 * | 11/2002 | Bernardi et al. | 336/90 |
| 2002/0158740 | A1 | 10/2002 | Paul et al. | |
| 2004/0108931 | A1 * | 6/2004 | Takeyama et al. | 336/96 |

FOREIGN PATENT DOCUMENTS

| | | |
|---|---|---|
| EP | 0 440 865 | 8/1991 |
| EP | 0 837 481 | 4/1998 |
| EP | 0 984 463 | 3/2000 |
| JP | 5175058 | 7/1993 |
| JP | 2002280237 | 9/2002 |
| WO | WO 97/22981 | 6/1997 |

OTHER PUBLICATIONS

Anonymous; Electronic Field Smoothing At The High Voltage Terminal Of An Ignition Coil; Research Disclosure, Kenneth Mason Publications; Jun. 18, 2000.

* cited by examiner

*Primary Examiner* — Anh T Mai
*Assistant Examiner* — Joselito Baisa
(74) *Attorney, Agent, or Firm* — Kenyon & Kenyon LLP

(57) ABSTRACT

An ignition coil of an ignition system in an internal combustion engine has a housing, a magnetically active core, a first coil winding connected to a supply voltage, and a second coil winding connected to a high-voltage terminal. At least one electrically conductive component is provided, at least in some areas, with a means for an electrically effective evening out of its surface.

13 Claims, 2 Drawing Sheets

IGNITION COIL

FIELD OF THE INVENTION

The present invention is directed to an ignition coil of an ignition system in an internal combustion engine.

BACKGROUND INFORMATION

An ignition coil is known from practice and is used, in particular, for triggering a spark plug of a motor vehicle's internal combustion engine operating by the spark ignition principle. The ignition coil forms an energy storage device and transformer via which electric power of a relatively low supply voltage, usually provided via a DC on-board electrical system of the particular motor vehicle, is converted into magnetic power, which is in turn converted into a high-voltage pulse at a certain point in time, when an ignition pulse is to be supplied to the spark plug used for igniting a fuel mixture in the combustion chamber of the engine.

The known ignition coil includes a housing in which a magnetically active core made of ferromagnetic material, for example, iron, is situated. The core is surrounded by a first, primary, winding connected to a supply voltage, and a second, secondary, winding connected to a high-voltage terminal of the ignition coil. Both windings are usually made of copper wire.

To convert the voltage delivered from the DC on-board electrical system of the motor vehicle into a high voltage, a current flows through the primary winding, which produces a closed magnetic field surrounding this winding and having a defined polarity. To deliver the stored electric energy in the form of high-voltage pulses, the electric current is turned off, so that the built-up magnetic field is forced to change polarity. This results in a high electric voltage in the secondary winding, which is near the primary winding and has a much higher number of turns than the primary winding. The previously formed magnetic field collapses due to the conversion of the now electric power at the spark plug. The spark plug discharges. Depending on the design of the secondary winding, the high voltage, a spark current, and a spark duration during ignition of the fuel mixture supplied to the combustion chamber of the engine may be adapted to the particular requirements.

To ensure the function of the ignition coil, the high voltage generated in it must be insulated from other electrically conductive parts. The secondary, i.e., high-voltage winding, is usually electrically insulated from other electrically conductive parts by electrically insulating materials and/or by air gaps. If such an insulation is insufficient, a secondary electric contact or an electrical breakdown from the high-voltage winding to another electrically conductive component of the ignition coil may occur. As a result, only a reduced high voltage, which is usually no longer sufficient for performing a reliable ignition at the spark plug, is available at the high-voltage terminal of the ignition coil.

In regard to an electrical breakdown, critical components of the ignition coil may include the windings and in particular components of the magnetically active core. The core is usually grounded, so that a large electric potential difference exists between the secondary winding, which is at high voltage, and the magnetically active core.

The risk of an electrical breakdown is determined not only by the potential difference, but also by the intensity of the electric field applied between the high-voltage winding and the particular electrically conductive component. The electric field intensity is highly dependent on the geometric conditions present. In particular, for physical reasons, corners or pointed surface contours of the particular component result in local increases in the field intensity, which in turn favor an electrical breakdown. Corners, points, or edges on electrically conductive parts situated in the range of influence of the high voltage thus represent a potential electrical breakdown risk in an ignition coil.

The magnetically active core is usually made of stamped individual metal sheets packed to form a stack of a certain height. Therefore, the stack has numerous corner-like or pointed uneven features, in particular at its sides, which may result in strong excessive field intensities and therefore in a breakdown during the operation of the ignition coil. To prevent the occurrence of electrical breakdowns, large insulation distances have been previously required or, when possible, good insulation materials have been used.

An object of the present invention is to provide an ignition coil in which, despite the existence of a rough surface on an electrically conductive component, the risk of an electrical breakdown is small, and which may be manufactured with compact dimensions.

SUMMARY OF THE INVENTION

The ignition coil according to the present invention of an ignition system in an internal combustion engine, in which ignition coil at least one electrically conductive component is provided, at least in some areas, with a means for an electrically effective evening out of its surface, has the advantage that design-related uneven features, which favor an electrical breakdown, such as corners, edges, burrs, and the like, are evened out on the electrically conductive component, and the risk of an electrical breakdown is minimized. The distance may thus be reduced compared to the related art, while keeping the potential difference between this component and a component conducting high voltage constant, which allows for smaller ignition coil sizes. Alternatively, a larger potential difference between a component conducting high voltage and the component provided with a means for an electrically effective evening out of its surface may be achieved even with the same distance, which in turn results in improved performance of the ignition coil.

In a preferred embodiment of the ignition coil according to the present invention, the means for an electrically effective evening out of the surface of the electrically conductive component is formed by an electrically conductive sheathing which has a smooth surface. This sheathing is an easy-to-apply means for covering or shielding a rough surface of the electrically conductive component, i.e., its uneven features, in an electrically effective manner. The sheathing thus reduces the excessive field intensities caused by the uneven features of the electrically conductive component. The risk of an electrical breakdown between a component conducting high voltage and the component provided with the sheathing is thus reduced.

The electrically conductive sheathing may be formed only in those areas of the electrically conductive component which have uneven features and thus carry the risk of breakdowns.

The sheathing is made, for example, of an electrically conductive plastic which is extruded onto the electrically conductive component or installed on the electrically conductive component as a separate part. It must always be ensured that the sheathing and the electrically conductive component are in contact.

The sheathing of the electrically conductive plastic has a thickness between 0.1 mm and 1 mm, preferably 0.5 mm, for example.

In particular, the electrically conductive component is the magnetically active core of the ignition coil, which is usually formed from a sheet metal stack formed by stamped individual metal sheets and may have corners, edges, burrs or the like on its sides.

The ignition coil according to the present invention is designed as a compact ignition coil, for example, which has an I core and a peripheral core, or O-core, which forms a magnetic circuit with the I core and encloses the system made up of the primary winding and the secondary winding. In this case, the component provided with the means for evening out the surface may be the I core and/or the peripheral core.

DETAILED DESCRIPTION

Figure 1:
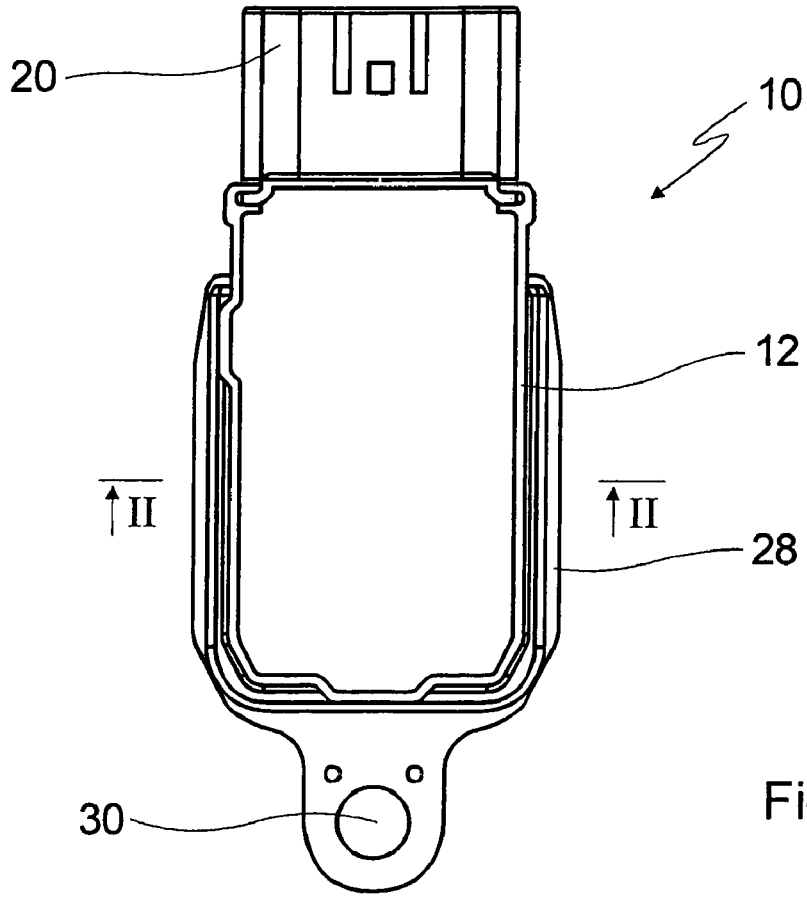
FIG. 1 shows a top view of an ignition coil according to the present invention.
Figure 2:
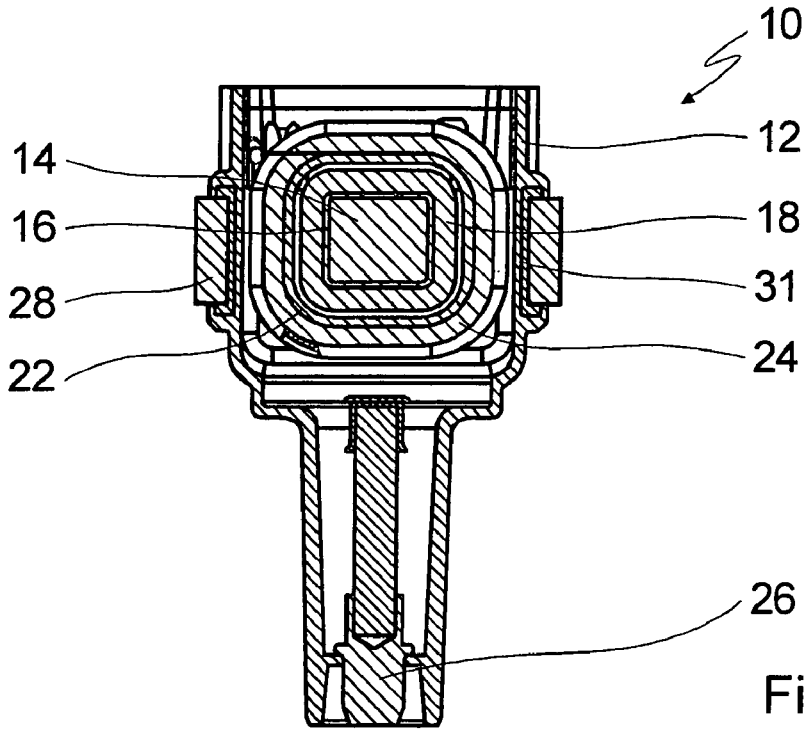
FIG. 2 shows a section through the ignition coil according to FIG. 1 along line II-II in FIG. 1.

FIGS. 1 and 2 show an ignition coil 10 of an ignition system in an internal combustion engine designed as a spark ignition engine of a motor vehicle, which is otherwise not illustrated in detail. Ignition coil 10 is used for supplying a spark plug, also not illustrated in detail here, with high-voltage pulses, to ignite an air/fuel mixture contained in the combustion chamber of the engine.

Ignition coil 10 represents a compact ignition coil and includes a housing 12 made of an electrically insulating plastic, in whose center a soft magnetic cuboid-shaped I core 14 is situated.

Magnetically active I core 14 is surrounded by an insulator 16 made of cast resin, which is used as a coil form for a primary winding 18 made of copper wire, which is connected to a DC power supply in the vehicle via a low-voltage terminal 20 and thus may be supplied with DC voltage of 12 V, for example.

Primary winding 18 is in turn surrounded by a coil form 22, which is used as the carrier for a secondary winding 24, which is under high voltage in operation and is connected to a high-voltage terminal 26 connected to a spark plug.

I core 14, coil form 16, primary winding 18, coil form 22, and secondary winding 24 form a module which is secured in housing 12 by being cast in cast resin in a way not shown here in detail.

At the level of I core 14, housing 12 is surrounded by an O core, or peripheral core 28, which is formed by a sheet metal stack, i.e., layered iron sheets, and is connected to I core 14 to form a magnetic circuit. The side of O core facing away from low-voltage terminal 20 has a screw lug 30, which is used for the ground contact.

On its inside, i.e., on its side facing secondary winding 24, O core 28 is provided with an extruded, electrically conductive plastic sheathing 31, which adjoins housing 12 via a smooth surface and is used as a means for electrically evening out the inside surface of O core 28 representing a sheet metal stack. Sheathing 31 has a thickness of approximately 0.5 mm.

Figure 3:
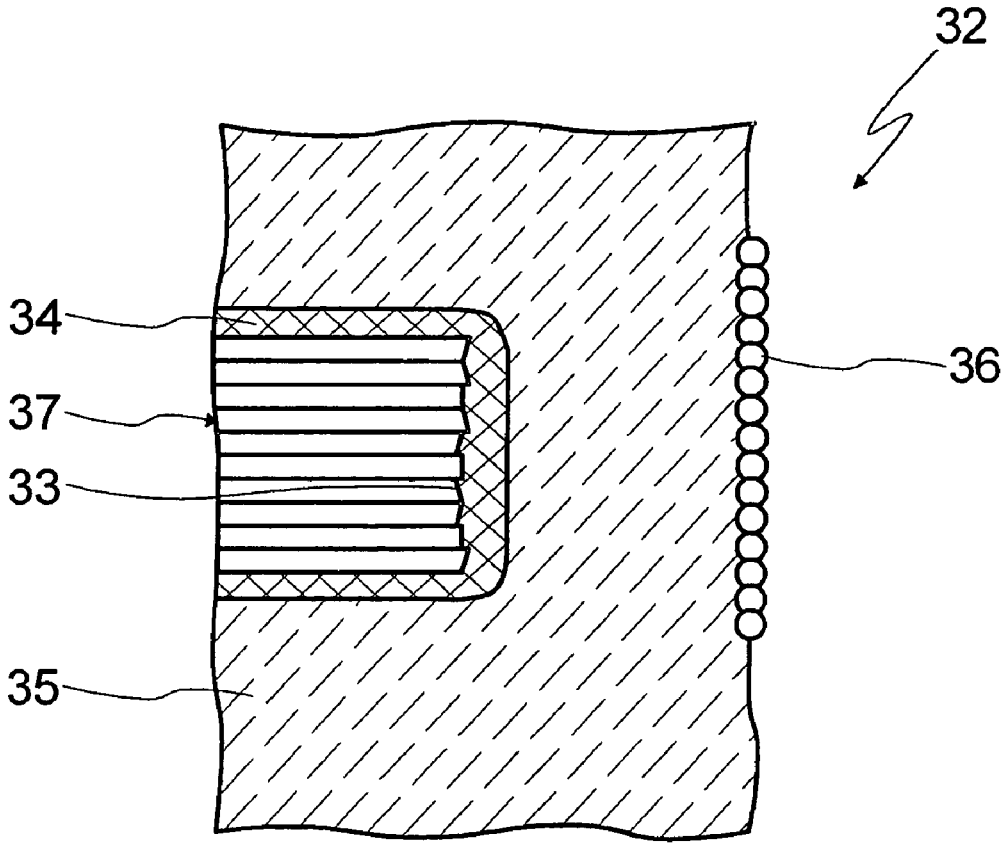
FIG. 3 shows an overall multiple section through an ignition coil.

FIG. 3 shows a schematic, overall representation of the relationships in an ignition coil 32 according to the present invention and illustrates how a plastic sheathing is able to "electrically even out" the otherwise excessive field intensities occurring due to the edges of the iron core, which would make the risk of an electrical breakdown much higher. Such a plastic sheathing may be used in compact ignition coils, but also in bar coils, for example.

Ignition coil 32 has a magnetically active iron core 37, which is formed by a sheet metal stack. Iron core 37 has a side 33 formed with sharp edges and is surrounded by a sheathing 34 made from an electrically conductive plastic, which has a smooth surface and represents a means for electrically evening out side 33. In the areas of corners of iron core 37, sheathing 34 is provided with radii. Iron core 37 and sheathing 34 are in turn embedded in an insulating material 35, which is made of cast resin, for example.

Iron core 37 cooperates with a secondary, i.e., high-voltage winding 36, of which the outer winding position is shown in FIG. 3, and which is connected to a high-voltage terminal, and with a low-voltage, i.e., primary, winding, which is not illustrated in detail in FIG. 3, and is connected to a low-voltage terminal.

What is claimed is:

1. An ignition coil of an ignition system in an internal combustion engine, comprising:

a housing;

a magnetically active core;

a first coil winding connected to a supply voltage;

a second coil winding connected to a high-voltage terminal; and at least one electrically conductive component having, at least in some areas, an arrangement for an electrically effective evening out of its inside surface, wherein the arrangement adjoins the housing by a smooth surface and wherein the magnetically active core adjoins the same arrangement, and wherein the electrically conductive component is a peripheral core of a ignition coil.

2. The ignition coil according to claim 1, wherein the arrangement is formed by an electrically conductive sheathing which has a smooth surface.

3. The ignition coil according to claim 2, wherein the sheathing is a layer of electrically conductive plastic.

4. The ignition coil according to claim 2, wherein the sheathing is extruded.

5. The ignition coil according to claim 1, wherein the electrically conductive component is the magnetically active core.

6. The ignition coil according to claim 1, wherein the sheathing is provided with radii in corners of the magnetically active core.

7. The ignition coil according to claim 1, wherein the arrangement is provided on the inside surface of the at least one electrically conductive component.

8. The ignition coil according to claim 1, wherein the arrangement is provided on the outside surface of the housing.

9. An ignition coil of an ignition system of an internal combustion engine, comprising;

a housing;

a magnetically active inner core, which is surrounded by a primary winding and a secondary winding; and a magnetically active outer core;

wherein at least the inner core, the primary winding and the secondary winding being surrounded by a cast resin for fixing in the housing, wherein the inner core is surrounded by a first electrically conductive plastic covering the inner core on a side facing the primary winding, and the outer core is surrounded by a second electrically conductive plastic covering the inside surface of the outer core on a side facing the secondary winding; and wherein the plastic covering is sprayed onto the inner core and the outer core as a coating.

10. The ignition coil of claim 9, wherein the thickness of each of the first and second plastic coverings is between 0.1 and 1.0 mm, preferably 0.5 mm.

11. The ignition coil of claim 9, wherein the first plastic covering has a smooth surface on the side facing the primary winding and the second plastic covering has a smooth surface on the side facing the secondary winding.

12. The ignition coil of claim 9, wherein the inner core and the outer core are each made up of a core stack having a plurality of punched single sheets.

13. The ignition coil of claim 9, wherein the second electrically conductive plastic adjoins the housing by a smooth surface.

* * * * *